US010107172B2

(12) United States Patent
Tempesta et al.

(10) Patent No.: US 10,107,172 B2
(45) Date of Patent: Oct. 23, 2018

(54) COOLING SYSTEM FOR AN INTERNAL COMBUSTION ENGINE

(71) Applicant: GM GLOBAL TECHNOLOGY OPERATIONS LLC, Detroit, MI (US)

(72) Inventors: Michele Tempesta, La Loggia (IT); Andrea Palma, Giaveno (IT); Fabio Numidi, Aglie (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 12 days.

(21) Appl. No.: 15/295,426

(22) Filed: Oct. 17, 2016

(65) Prior Publication Data

US 2017/0107889 A1 Apr. 20, 2017

(30) Foreign Application Priority Data

Oct. 16, 2015 (GB) ..... 1518340.3

(51) Int. Cl.
*F02F 1/40* (2006.01)
*F01P 3/02* (2006.01)
*F02F 1/10* (2006.01)

(52) U.S. Cl.
CPC *F01P 3/02* (2013.01); *F02F 1/10* (2013.01); *F02F 1/40* (2013.01); *F01P 2003/021* (2013.01); *F01P 2003/024* (2013.01); *F01P 2003/027* (2013.01); *F02F 2001/104* (2013.01)

(58) Field of Classification Search
CPC ..... F02F 2001/104; F02F 1/40; F02F 11/002; F01P 2003/027; F01P 2003/028
USPC ..... 29/888.06
See application file for complete search history.

(56) References Cited

U.S. PATENT DOCUMENTS 4,175,503 A * 11/1979 Ernest ..... F01P 3/02 123/193.3
5,086,733 A * 2/1992 Inoue ..... F01P 3/02 123/41.79
8,833,073 B2 * 9/2014 Kuhlbach ..... F01P 7/165 123/41.1
2011/0296834 A1 * 12/2011 Kuhlbach ..... F01P 7/165 60/605.3

(Continued)

FOREIGN PATENT DOCUMENTS

GB 2286039 A 8/1995
GB 2348485 A 10/2000
JP 2012163005 A 8/2012

OTHER PUBLICATIONS

Great Britain Patent Office, Great Britain Search Report for Great Britain Application No. 1518340.3, dated Feb. 23, 2016.

*Primary Examiner* — Hung Q Nguyen
*Assistant Examiner* — Mark L Greene
(74) *Attorney, Agent, or Firm* — Lorenz & Kopf, LLP

(57) ABSTRACT

A cooling system for an internal combustion engine is disclosed. The engine has a cylinder block and a cylinder head. The cooling system includes a cylinder head cooling circuit and a cylinder block cooling circuit. The cylinder block cooling circuit includes cylinder block core prints channels on an upper portion thereof. The cylinder head cooling circuit includes a groove connected to an outlet of the cooling system and at least one cylinder block core print channel provided with at least one passage connecting the cylinder block cooling circuit with the groove.

14 Claims, 3 Drawing Sheets

(56) References Cited

U.S. PATENT DOCUMENTS

2015/0345364 A1 12/2015 Hutchins
2016/0356201 A1* 12/2016 Petutschnig ..... F01P 3/02

* cited by examiner

COOLING SYSTEM FOR AN INTERNAL COMBUSTION ENGINE

CROSS-REFERENCE TO RELATED APPLICATION

This application claims priority to Great Britain Patent Application No. 1518340.3, filed Oct. 16, 2015, which is incorporated herein by reference in its entirety.

TECHNICAL FIELD

The present disclosure pertains to a cooling system for an internal combustion engine.

BACKGROUND

Internal combustion engines are equipped with a cooling system. The cooling system is generally provided for cooling down the internal combustion engine, as well as other engine fluids, such as for example the exhaust gas in the EGR cooler and/or the lubricating oil in the oil cooler. The cooling system schematically includes a coolant pump that delivers a coolant fluid, typically a mixture of water and antifreeze, from a coolant tank to a plurality of cooling channels. In some applications, the cooling system is split into two fluidically separate cooling circuits, one for the engine's cylinder block and one for the engine's cylinder head for example for optimizing engine warm up and improve fuel emissions.

An issue may arise due to the fact that, in the cooling circuit of the cylinder block, which is in a lower position with respect to the cooling circuit for the cylinder head, steam bubbles may be formed therein in case of boiling phenomena that may occur during operation of the engine. In general air bubbles could be present in the cylinder block cooling circuit and therefore could remain trapped within the cylinder block cooling circuit, especially in its upper portion and for this specific design.

SUMMARY

The present disclosure provides a cooling system for an internal combustion engine that helps to avoid the accumulation of air/steam bubbles in the upper portion of the cooling circuit of the engine block. An embodiment of the disclosure provides a cooling system for an internal combustion engine, the engine having a cylinder block and a cylinder head. The cooling system includes a cylinder head cooling circuit and a cylinder block cooling circuit. The cylinder block cooling circuit includes cylinder block core prints channels on an upper portion thereof. The cylinder head cooling circuit includes a groove connected to an outlet of the cooling system and at least one cylinder block core print channel is provided with at least one passage connecting the cylinder block cooling circuit with the groove. An advantage of this embodiment is that it allows to collect air/steam bubble that may be created, for example by boiling phenomena during operation of the engine, and discharge them towards the outlet of the cooling system. At the same time, this embodiment maintains a separate control of the cooling circuit for the cylinder block of the engine and of the cooling circuit for the cylinder head of the engine. Finally, the above embodiment does not to use added components, contributing to cost control.

According to an embodiment of the present disclosure, a gasket is provided in order to seal an interface between the cooling circuit for the cylinder head and the cooling circuit for the cylinder block, and the at least one passage, for connecting the cylinder block cooling circuit with the groove, is provided inside the gasket. An advantage of this embodiment is that it provides a fluidic continuity to the air/steam bubbles in order to be discharged from the cooling circuit for the cylinder block, and in particular from the cylinder block core prints channels into the groove, while maintain a separation between main cylinder block cooling circuits and the cylinder head cooling circuit, which can be controlled separately.

More in detail, according to an aspect of the present disclosure, the number and dimension of the passage connecting the cylinder block cooling circuit with the groove are selected/designed in order to allow an effective evacuation of air/steam bubble from the cylinder block cooling circuit into the groove, while at the same time allowing a separate control of the cylinder block cooling circuit and the cylinder head cooling circuit.

According to another embodiment of the present disclosure, the passages are fluidically connected to an upper part of the cylinder block core prints channels. An advantage of this embodiment is that the passages are provided in an uppermost portion of the cooling circuit for the cylinder block of the engine allowing an easy degassing of such circuit.

According to another embodiment of the present disclosure, the cylinder head cooling circuit includes cylinder head core print channels connecting the cylinder head cooling circuit with the groove.

According to another embodiment of the present disclosure, the groove is provided on a deckface of the cylinder head. An advantage of this embodiment is that it allows to utilize a convenient space for the groove. According to another embodiment of the present disclosure, the groove is machined on the deckface of the cylinder head. According to another embodiment of the present disclosure, the groove is cast on the deckface of the cylinder head. An advantage of these two embodiments is that they allow for alternative ways to realize the groove, by exploiting the shape of the deckface.

According to another embodiment of the present disclosure, the groove is connected to an outlet of the cylinder block cooling circuit, thus advantageously discharge air/steam bubbles by means of the groove into the cooling circuit which is in turn provided with known venting means. According to another embodiment of the present disclosure, the groove is separated and independent from other portions of the cylinder head cooling circuit. An effect of this embodiment of the present disclosure is to allow the possibility of two different and independent cooling strategies between the cylinder head and the cylinder block, optimizing the overall thermal management of the engine as required.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description. Exemplary embodiments will now be described with reference to the enclosed drawings without intent to limit application and uses.

Figure 1:
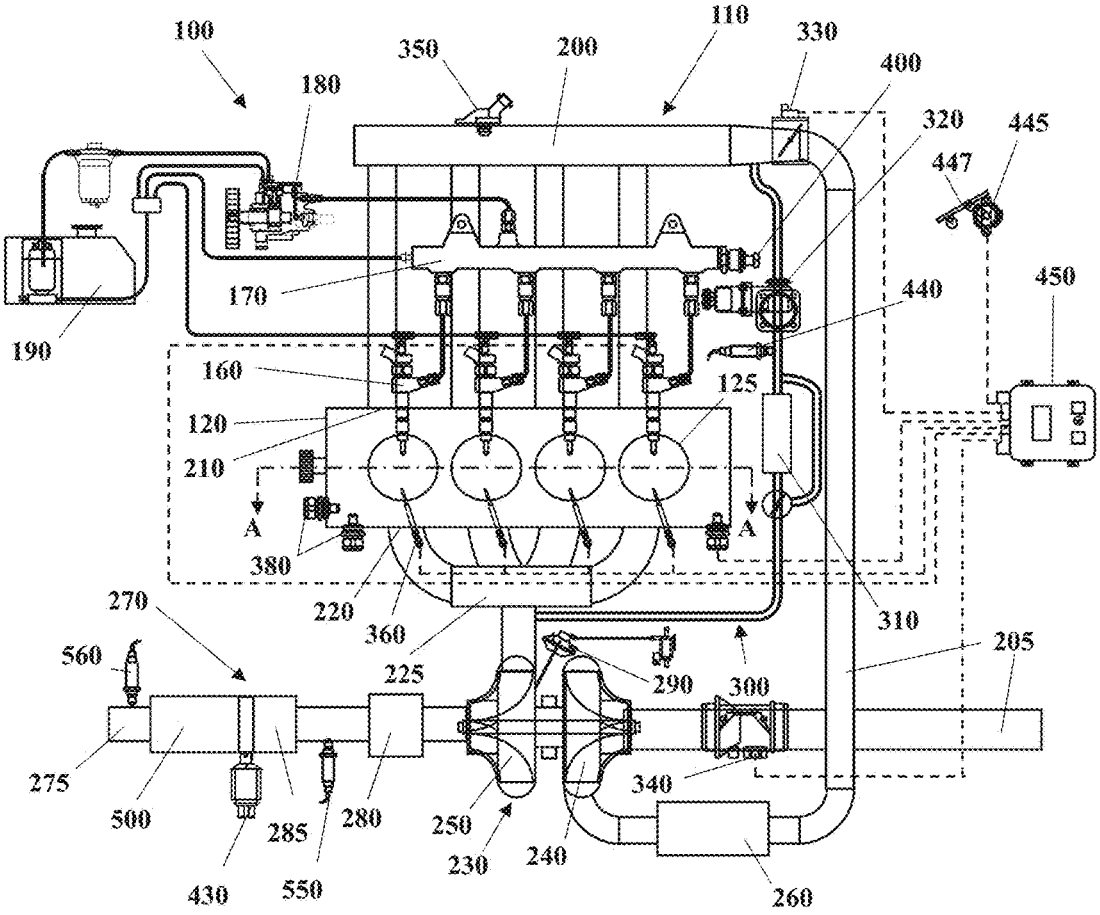
FIG. 1 shows an automotive system.
Figure 2:
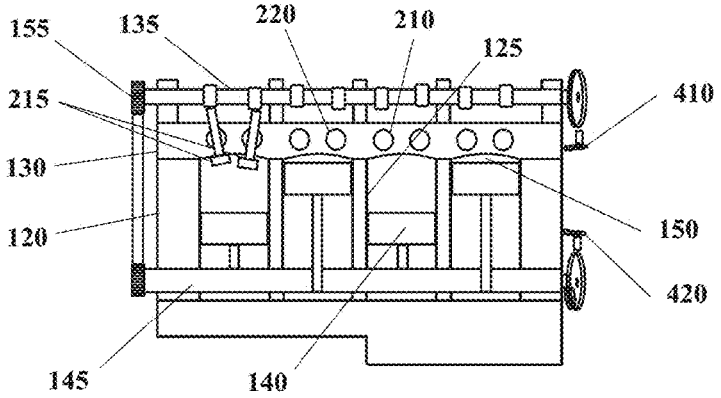
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having a cylinder block 120 defining at least one cylinder 125 having a piston 140 coupled to rotate a crankshaft 145. A cylinder head 130 cooperates with the piston 140 to define a combustion chamber 150. A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200.

In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust gases of the engine are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110 and with a memory system, or data carrier, and an interface bus. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, a Variable Geometry Turbine (VGT) actuator 290, and the cam phaser 155. Note, dashed lines are used to indicate communication between the ECU 450 and the various sensors and devices, but some are omitted for clarity.

Figure 3:
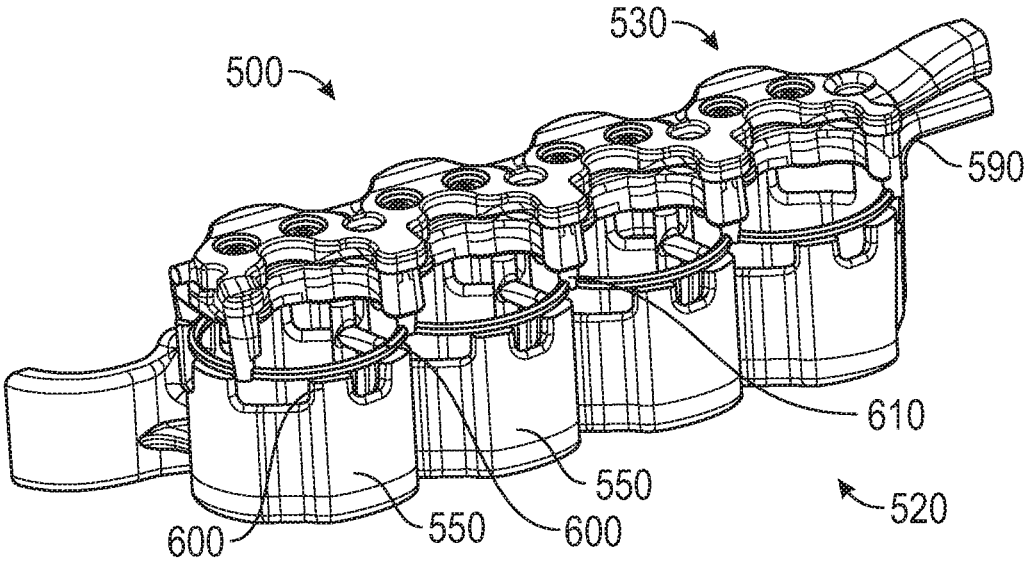
FIG. 3 is an axonometric view of a cooling system for the engine of FIGS. 1-2.
Figure 4:
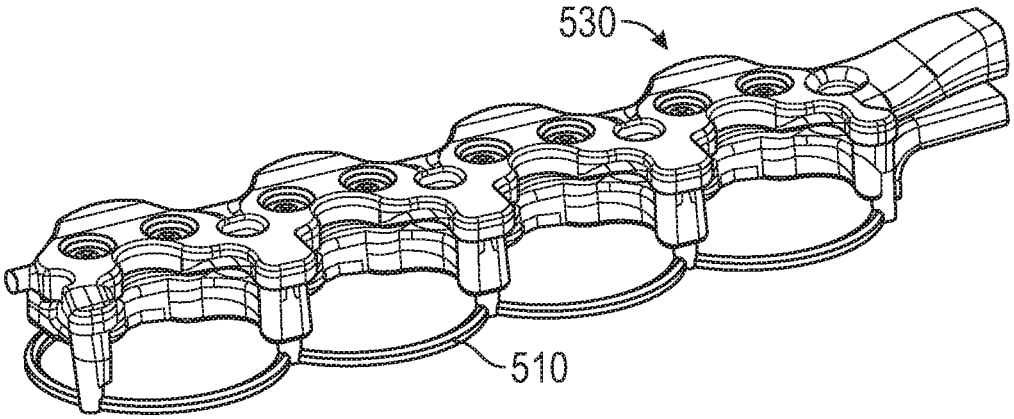
FIG. 4 is an axonometric view of a cooling circuit for a cylinder head of the engine of FIGS. 1-2.

FIG. 3 is an axonometric view of a cooling system 500 for the engine 110 of FIGS. 1-2. The cooling system 500 includes a cooling circuit 530 for the cylinder head 130 of the engine 110 (also represented in FIG. 4) and a cooling circuit 520 for the cylinder block 120 of the engine 110. Each of these cooling circuits 520,530 allow the circulation of a coolant fluid, such as a mixture of water and antifreeze, into a plurality of cooling channels internally defined respectively in the cylinder block 120 and in the cylinder head 130, forming respective water jackets.

In particular, according to an embodiment of the present disclosure, the cooling circuit 530 for the cylinder head 130 includes a groove 510 connected to an outlet of the cooling system 500. For example, the groove 510 may be connected to an outlet 590 of the cylinder block 120 cooling circuit 520. The cooling circuit 520 for the cylinder block 120 includes a plurality of cylinder block core prints channels 550 on an upper portion thereof.

As it is known, in the casting process core prints are used to support the core element used to provide an empty volume within the cylinder block, used for example as a cooling circuit (water jacket). At the end of the casting process, the core prints are removed and create cylinder block core print channels 550. In particular, the cylinder block core prints channels 550 are shaped in such a way as to form upper parts 560 of the cylinder block cooling circuit. The upper parts 560 being located in a proximal position with respect to the groove 510 (FIG. 6) and are distanced from lower parts 570.

Furthermore, according to an embodiment of the present disclosure, a plurality of passages 600 are provided to fluidically connect the upper part 560 of the cylinder block core prints channels 550 with the groove 510. Each of the plurality of passages 600 connect the cooling circuit 520 for the cylinder block 120 of the engine 110 with the groove 510. In particular, each of the plurality of passages 600 connects the upper part 560 of the cylinder block core prints channels 550 with the groove 510. Each of the upper part 560 of the core prints channels 550 may have one or more passages 600.

Figure 6:
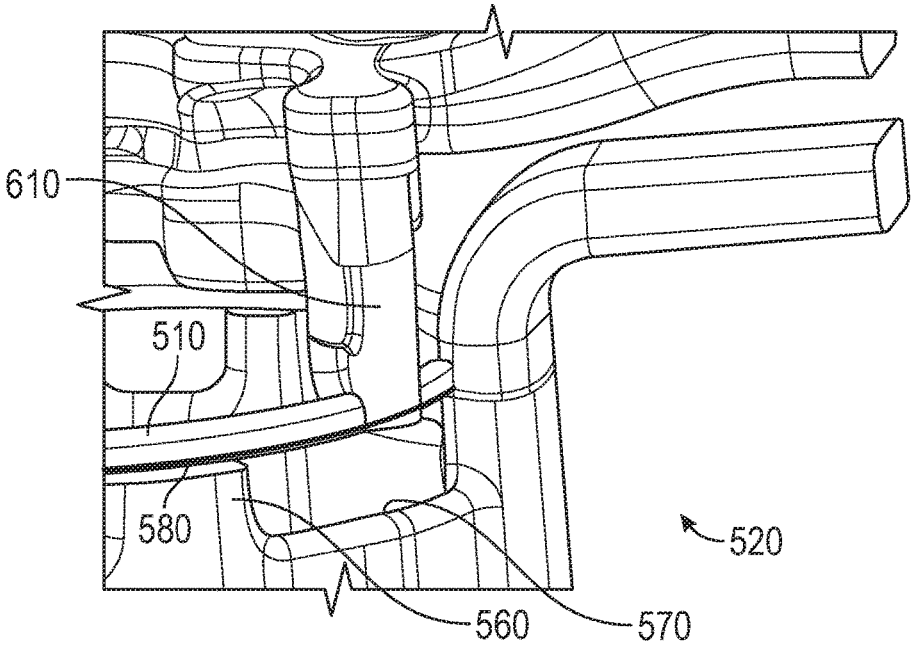
FIG. 6 is a close up view of the cooling system of FIG. 3.

The diameter of the passages 600 may be suitably calibrated (using specific holes in the head gasket 580) to allow passing of steam bubbles that may be formed in the cooling circuit 520 for the cylinder block 120 during operations of the engine 110. The diameter of the passages 600 may be equal for each hole, or in the alternative, may vary depending on the position of the respective hole. Moreover, the cylinder head 130 cooling circuit 530 also includes cylinder head 130 core print channels 610 connecting the cylinder head 130 cooling circuit 530 with the groove 510 (FIG. 6).

Figure 5:
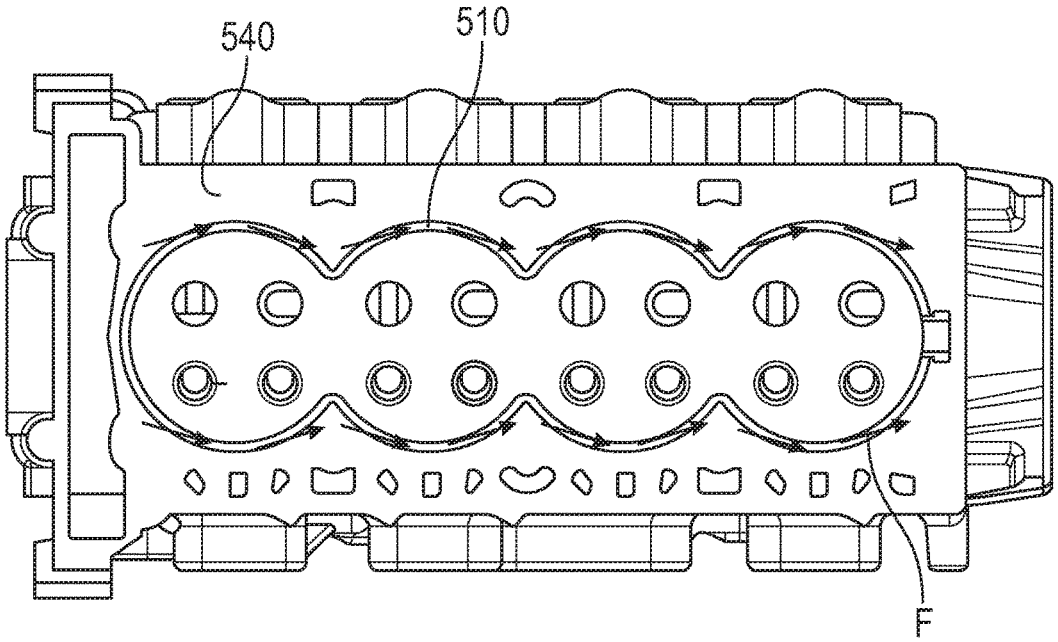
FIG. 5 is view from below of a cylinder head of the engine of FIGS. 1-2, showing a deckface.

Referring now to FIG. 5, a view from below of a cylinder head 130 of the engine 110 is represented, showing a deckface 540. According to an embodiment of the present disclosure, the groove 510 is provided on the deckface 540 of the cylinder head 130. More specifically, the groove 510 is machined on the deckface 540 of the cylinder head 130. According to another embodiment, the groove 510 is cast on the deckface 540 of the cylinder head 130. According to still another embodiment, the groove 510 may be separated and independent from other portions of the cylinder head cooling circuit 530.

Furthermore, according to another embodiment, a gasket 580 is provided in order to seal an interface between the cooling circuit 530 for the cylinder head 130 and the cooling circuit 520 for the cylinder block 120. The gasket 580 is provided with holes to allow space for the passages 600 connecting the cylinder block 120 cooling circuit 520 with the groove 510. During operation of the engine, air/steam bubbles may form in the cooling circuit 520 for the cylinder block 120. Such air/steam bubbles are then collected in the upper part 560 of the cylinder block core prints channels 550 and then exit from the calibrated passages 600. Therefore, air/steam bubbles flow through the sealed interface between the cooling circuit 530 for the cylinder head 130 and the cooling circuit 520 for the cylinder block 120 and are then collected into the groove 510. Finally, air/steam bubbles follow the path depicted by arrows F in FIG. 5 and exit towards an outlet of the cooling circuit 500, for example towards an outlet 590 of the cooling circuit 520 for the cylinder block 120.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A cooling system for an internal combustion engine having a cylinder block and a cylinder head, the cooling system comprising:

a cylinder block cooling circuit including cylinder block core prints channels on an upper portion thereof, the cylinder block core prints channels partially defining a plurality of water jackets for combustion chambers of the internal combustion engine;

a cylinder head cooling circuit;

an interface defined between the cylinder block cooling circuit and the cylinder head cooling circuit, the interface extending in a lateral direction to intersect the plurality of water jackets; and a fluid outlet of the cylinder block cooling circuit on the upper portion thereof;

the cylinder head cooling circuit including a groove that extends along the interface and amongst the plurality of water jackets;

at least one of the cylinder block core prints channels provided with at least one passage fluidically connecting the cylinder block cooling circuit with the groove; and the groove including an upstream area and a downstream area that are spaced apart in the lateral direction;

the fluid outlet being fluidically connected to the groove at the downstream area.

2. The cooling system according to claim 1, further comprising a gasket configured to seal the interface between the cylinder head cooling circuit and the cylinder block cooling circuit, said at least one passage being provided inside the gasket.

3. The cooling system according to claim 1, wherein the at least one passage is fluidically connected to an upper part of the cylinder block core prints channels.

4. The cooling system according to claim 1, wherein the cylinder head cooling circuit comprises cylinder head core print channels connecting the cylinder head cooling circuit with the groove.

5. The cooling system according to claim 1, wherein the groove is provided on a deckface of the cylinder head.

6. The cooling system according to claim 5, wherein the groove comprises a machined groove in the deckface of the cylinder head.

7. The cooling system according to claim 5, wherein the groove comprises a cast groove formed in the deckface of the cylinder head.

8. An internal combustion engine comprising:

a cylinder block;

a cylinder head; and a cooling system comprising:

a cylinder block cooling circuit including cylinder block core prints channels on an upper portion thereof, the cylinder block core prints channels partially defining a plurality of water jackets for combustion chambers of the internal combustion engine;

a cylinder head cooling circuit;

an interface defined between the cylinder block cooling circuit and the cylinder head cooling circuit, the interface extending in a lateral direction to intersect the plurality of water jackets; and a fluid outlet of the cylinder block cooling circuit on the upper portion thereof;

the cylinder head cooling circuit including a groove that extends along the interface and amongst the plurality of water jackets;

at least one of the cylinder block core prints channels provided with at least one passage fluidically connecting the cylinder block cooling circuit with the groove; and the groove including an upstream area and a downstream area that are spaced apart in the lateral direction;

the fluid outlet being fluidically connected to the groove at the downstream area.

9. The cooling system of claim 1, wherein the upstream area and the downstream area are disposed on opposite ends of the interface;

wherein the downstream area is fluidically connected to the fluid outlet of the cylinder block cooling circuit;

wherein the groove extends continuously from the upstream area to the downstream area.

10. The cooling system of claim 9, wherein the combustion chambers are arranged in a sequence from a first chamber to a second chamber;

wherein the upstream area of the groove contours and partially encompasses the first chamber; and wherein the downstream area of the groove contours and partially encompasses the second chamber.

11. The cooling system of claim 1, wherein the at least one of the cylinder block core prints channels forms an upper part of the cylinder block cooling circuit;

the at least one passage fluidically connecting the upper part to the groove;

the at least one of the cylinder block core prints channels forming a lower part that is spaced apart at a distance in a longitudinal direction from the groove; and the lower part disposed, in a circumferential direction, between the upper part and the fluid outlet;

the lower part fluidly connecting the upper part and the fluid outlet.

12. A cooling system for an internal combustion engine having a cylinder block and a cylinder head, the cooling system comprising:

a cylinder block cooling circuit including cylinder block core prints channels on an upper portion thereof, the cylinder block core prints channels partially defining a plurality of water jackets for respective combustion chambers of the internal combustion engine, the plurality of water jackets arranged in a series in a lateral direction;

a cylinder head cooling circuit;

a gasket that seals an interface between the cylinder block cooling circuit and the cylinder head cooling circuit, the gasket extending in the lateral direction to intersect the plurality of water jackets;

a fluid outlet of the cylinder block cooling circuit on the upper portion thereof;

the cylinder head cooling circuit including a groove that extends in the lateral direction along the gasket to continuously encompass the combustion chambers;

the groove including an upstream area and a downstream area that are spaced apart in the lateral direction;

the cylinder block core prints channels each provided with a passage that extends through the gasket and that fluidically connects the cylinder block cooling circuit with the groove;

the fluid outlet being fluidically connected to the groove at the downstream area;

the cooling system configured to contain a first fluid flow from the cylinder block cooling circuit to the fluid outlet; and the cooling system configured to contain a second fluid flow from the cylinder block cooling circuit, through the passages and the gasket to the groove for movement in the lateral direction, generally away from the upstream area to the downstream area and to the fluid outlet.

13. The cooling system of claim 12, wherein the plurality of combustion chambers are arranged in a sequence from a first chamber to a second chamber;

wherein the upstream area of the groove contours and partially encompasses the first chamber; and wherein the downstream area of the groove contours and partially encompasses the second chamber.

14. The cooling system of claim 13, wherein the cylinder block core prints channels form an upper part of the cylinder block cooling circuit;

the passages fluidically connecting the upper part to the groove;

of the cylinder block core prints channels forming a lower part that is spaced apart at a distance, in a longitudinal direction, from the groove;

the lower part disposed, in the lateral direction, between the upper part and the fluid outlet;

the lower part fluidically connecting the upper part and the fluid outlet.

* * * * *